US007780046B1

(12) United States Patent
Lowe

(10) Patent No.: US 7,780,046 B1
(45) Date of Patent: Aug. 24, 2010

(54) PIVOTING CONTAINER TOP

(76) Inventor: John P. Lowe, 395 Coolidge Rd., Birmingham, MI (US) 48009

( * ) Notice: Subject to any disclaimer, the term of this patent is extended or adjusted under 35 U.S.C. 154(b) by 1221 days.

(21) Appl. No.: 11/358,269

(22) Filed: Feb. 21, 2006

(51) Int. Cl.
*B67D 3/00* (2006.01)

(52) U.S. Cl. ..... 222/517; 222/556; 215/235; 220/254.1; 220/254.5

(58) Field of Classification Search ..... 222/517, 222/516, 498, 1, 556, 548, 565; 215/200, 215/235; 220/254.1, 255, 254.2, 254.3, 254.5, 220/259.1
See application file for complete search history.

(56) References Cited

U.S. PATENT DOCUMENTS 385,328 A * 6/1888 Robertson et al. ..... 222/487
596,244 A * 12/1897 Lied ..... 222/487
608,502 A * 8/1898 Sewall et al. ..... 222/487
694,932 A * 3/1902 Sewall et al. ..... 222/487
1,548,150 A * 8/1925 Mace ..... 222/142.1
3,877,600 A * 4/1975 Beil ..... 220/826
4,558,806 A 12/1985 Shabram, Sr. et al.
5,485,938 A * 1/1996 Boersma ..... 220/714
5,687,762 A 11/1997 Teets et al.
5,894,950 A 4/1999 Kick
6,257,449 B1 7/2001 Baerenwald

* cited by examiner

*Primary Examiner*—Frederick C. Nicolas
(74) *Attorney, Agent, or Firm*—Brooks Kushman P.C.

(57) ABSTRACT

A closure for closing an opening of a container to enable dispensing of material from or inserting material into the container. The closure includes a lid and a pivotable member adjacent to the lid. The lid is configured to completely cover the opening of the container. The pivotable member is positioned in the interior of the container when the container is closed.

29 Claims, 5 Drawing Sheets

PIVOTING CONTAINER TOP

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION (1) Field of the Invention

The present invention relates to a closure for a container. In particular, the present invention relates to a closure which has a pivotable member which pivots in the interior of the container to open and close the container.

(2) Description of the Related Art

The related art has shown various types of closures for containers. Illustrative are U.S. Pat. Nos. 4,558,806 to Shabram, Sr. et al.; 5,894,950 to Kick; and 6,257,449 to Baerenwald.

Shabram, Sr. et al. describes a closure cap for a container containing a granular solid. The cap has a coverflap portion and a body portion. The body portion has apertures which allow for pouring of the granular contents. The coverflap has hinge posts which fit into recesses in the body portion and allow the coverflap to pivot in response to finger pressure. The body portion has a relief cavity to receive the depressable portion of the coverflap to allow the coverflap to pivot to open the apertures. The coverflap has sealing protrusions that fit into the apertures.

Kick describes an end closure for a shake and pour container. The closure includes a cover and a break open lid. The cover provides for sealing the contents of the container and the break open lid permits access to the contents of the container. The closure has a locking tab which automatically snap locks the lid in the fully open position. The closure also has a closing tab which projects upwardly from the closure away from the container when the lid is in the fully open position allowing for easy re-close of the lid.

Baerenwald describes a closure for a container having a base and a lever pivotably attached to the base. The base is adapted to be secured adjacent a pouring lip of the container and has an opening disposed proximate a scored area of the container. The lever includes a puncturing end and a pour spout end. The lever is adapted to move between a storage position with the lever substantially parallel to the base and a pouring position with the lever orthogonal to the base. When the lever is in the pouring position, the spout end is displaced away from the container and the puncturing end is displaced into the container through the scored area of the container.

Also of interest is U.S. Pat. No. 5,687,762 to Teets et al. Teets et al. describes a fluid control valve for a vehicle fuel tank. The fluid control valve interconnects the liquid fuel feed and the vaporous fuel exhaust valve so that when liquid is introduced into the tank at the fuel feed, the fuel impacts the liquid fuel control valve and displaces the liquid fuel valve downward away from the annular valve seat surface so that liquid fuel can flow freely into the tank. When the liquid fuel valve is displaced, the mechanical linkage connecting the liquid fuel feed valve and the vaporous fuel vent valve, simultaneously displaces the vaporous fuel vent valve upward away from the annular sealing surface to an open position so that fuel vapors can flow out of the tank to an exhaust passage.

There remains a need for a closure for a container which is easy to open and close and which can be opened and closed numerous times.

SUMMARY OF THE INVENTION

A closure for closing an opening of a container to enable dispensing material from or inserting material into the container. The closure includes a lid, a pivotable member and a means for holding the pivotable member adjacent to the lid. The lid is configured to completely cover the opening of the container. The pivotable member and the means for holding the pivotable member adjacent to the lid are positioned in the interior of the container.

The lid can have a variety of shapes and sizes as necessary to cover the opening in the container. The lid has two (2) openings. One (1) opening allows access to the interior of the container for filling the container with material and/or dispensing material from the container. The other opening allows one (1) end of the pivotable member to extend out of the interior of the container. The pivotable member can have a variety of shapes and sizes depending on the positioning of the openings in the lid and the intended use of the container. The pivotable member has opposed ends with a first surface and a second surface extending therebetween. The shape and size of the ends depends on the shape and size of the openings in the lid. In one (1) embodiment, the ends of the pivotable member extend into the openings in the lid. In another embodiment, the ends contact the lid around the perimeter of the openings and cover the openings.

The pivotable member has a first surface and a second surface. In one (1) embodiment, the first surface is spaced apart from the second surface. The second surface of the pivotable member has a curved shape. In one (1) embodiment, the second surface of the pivotable member has an essentially semi-circular shape. In one (1) embodiment, the second surface is smooth. A pivot surface is provided along the first surface. In one (1) embodiment, the pivot surface is positioned essentially at the centerline of the pivotable member spaced an equal distance from the second surfaces of the pivotable member at the ends of the pivotable member. In another embodiment, the pivot surface is offset from the centerline in a direction toward the second end of the pivotable member. The first surface can have a variety of shapes. The first surface of the pivotable member has a first recess spaced between the second end and the pivot surface. The first recess extends downward toward the second surface and extends across the entire width of the pivotable member between the sides of the pivotable member. The pivotable member may have a second recess spaced between the first end and the pivot surface. The first and second recesses allow the pivotable member to pivot in both directions on the pivot surface. The means for holding the pivotable member adjacent to the lid can be any means well known in the art. The holding means holds the pivotable member adjacent to the lid while allowing the pivotable member to pivot and to move on the lid. The means for holding the pivotable member holds the pivotable member so that the pivot surface is in contact with the lid and the pivotable member pivots on the pivot surface. In one (1) embodiment, the means for holding the pivotable member in position is a resilient member which exerts a force on the second surface of the pivotable member and moves the pivotable member upward into contact with the lid. In one (1) embodiment, the resilient member is a spring mechanism.

To use the closure to open the container, the first end of the pivotable member is pushed downward or inward into the interior of the container or the second end is pulled upward away from the interior of the container. The shape of the pivotable member causes the pivotable member to pivot on the pivot surface which moves the first end in an arcuate path toward a center of the lid within the interior of the container and moves the second end of the pivotable member in an arcuate path toward the center of the lid on the outside of the container. As the pivotable member moves toward the fully open position, the shape of the pivotable member cams against the spring mechanism so that the spring mechanism exerts a greater force on the second surface of the pivotable member as the pivotable member pivots to the open position. The greater force combined with the shifting of the pivot surface in relation to direction of the force applied to the pivot surface by the spring mechanism tends to lock the pivotable member in the fully open position. To close the closure, a force is applied to the second end of the pivotable member. The amount of force applied must be greater than the force tending to hold the pivotable member in the open position. In one (1) embodiment, the shape of the second surface of the pivotable member and the positioning of the pivot surface causes the distance between the pivot surface and the second surface to increase as the pivotable member moves to the open position. This increase in distance also causes the closure to accelerate toward the closed position once the pivotable member is moved out of the fully open position.

The present invention relates to a closure for a container having an opening, the closure which comprises: a lid having a first opening and a second opening and configured to cover the opening of the container; a pivotable member having a first end and a second end with a first surface and a second surface extending therebetween and positioned adjacent the lid; a pivot surface provided on the pivotable member between the ends of the pivotable member; and a means for holding the pivotable member adjacent to the lid so that when the pivotable member moves between open and closed positions, the pivot surface contacts the lid and the pivotable member pivots on the pivot surface.

Further, the present invention relates to a container having an opening allowing access to an interior of the container and having a closure for preventing access to the interior of the container, the closure which comprises: a lid having a first opening and a second opening and configured to cover the opening of the container; a pivotable member positioned adjacent the lid having a first end and a second end with a spaced apart first surface and a second surface extending therebetween; a pivot surface provided along the first surface of the pivotable member; and a means for holding the pivotable member adjacent the lid so that when the pivotable member moves between open and closed positions, the pivot surface contacts the lid and the pivotable member pivots on the pivot surface.

Finally, the present invention relates to a method for dispensing material from a container having an opening which comprises the steps of: providing a closure including a lid having a first opening and a second opening, a pivotable member having a first end and a second end with a first surface and a second surface extending therebetween with a pivot surface provided along the first surface, and a means for holding the pivotable member adjacent the lid; securing the lid on the opening of the container; moving the pivotable member into an open position such that the first end of the pivotable member is in an interior of the container spaced apart from the first opening in the lid and the second end of the pivotable member is spaced above the lid on a side opposite the interior of the container, wherein as the pivotable member is moved to the open position, the means for holding the pivotable member adjacent the lid exerts an upward force on the second surface of the pivotable member to keep the pivotable member in contact with the lid; dispensing the material from the first opening in the lid of the closure; and moving the pivotable member into a closed position such that the first end of the pivotable member closes the first opening in the lid of the closure and the second end of the pivotable member closes the second opening in the lid of the closure wherein as the pivotable member is moved from the open position to the closed position, the means for holding the pivotable member adjacent the lid exerts a force on the second surface of the pivotable member.

The substance and advantages of the present invention will become increasingly apparent by reference to the following drawings and the description.

BRIEF DESCRIPTION OF THE PREFERRED EMBODIMENTS

Figure 1:
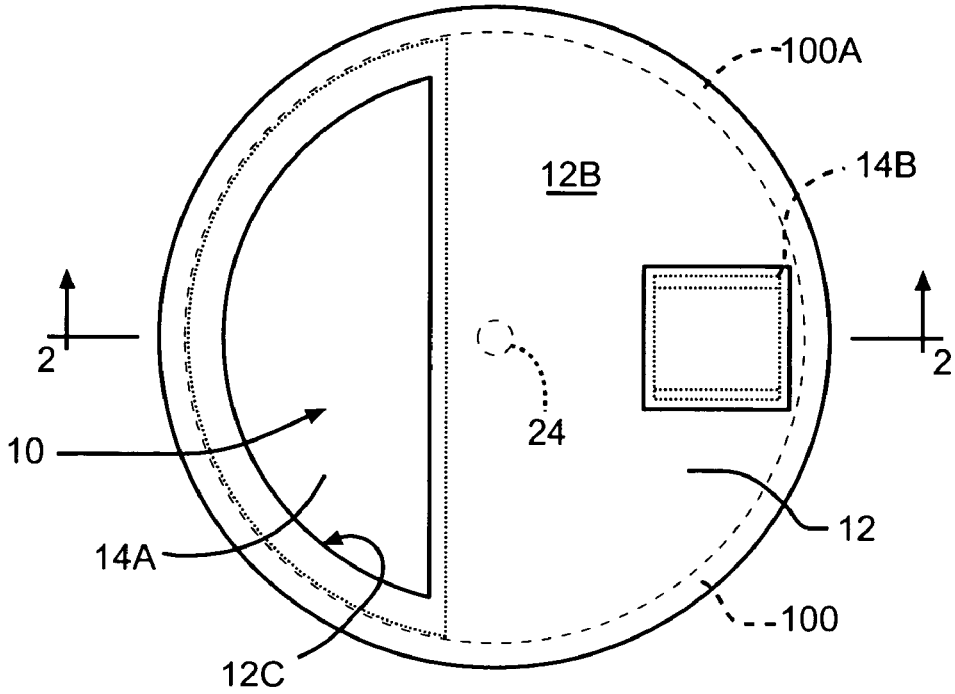
FIG. 1 is a top view of the container 100 and the closure 10 of one (1) embodiment of the invention.
Figure 2:
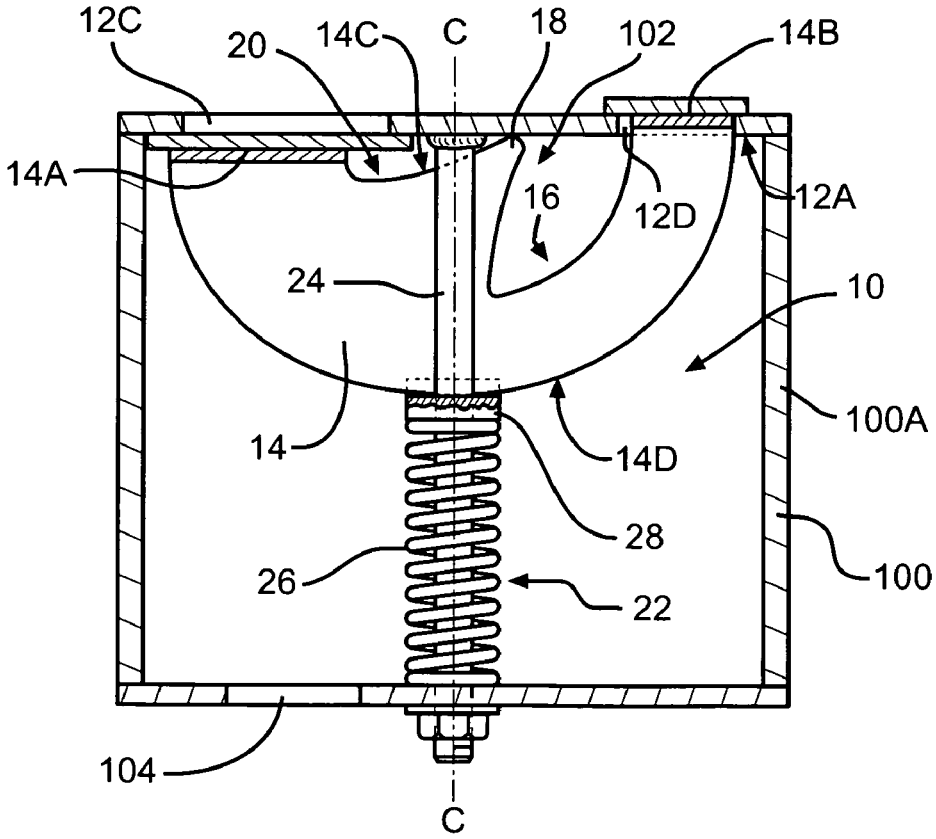
FIG. 2 is a cross-sectional view along the line 2-2 of FIG. 1 showing the closure 10 in the closed position with the spring mechanism 22 in elevation.
Figure 3:
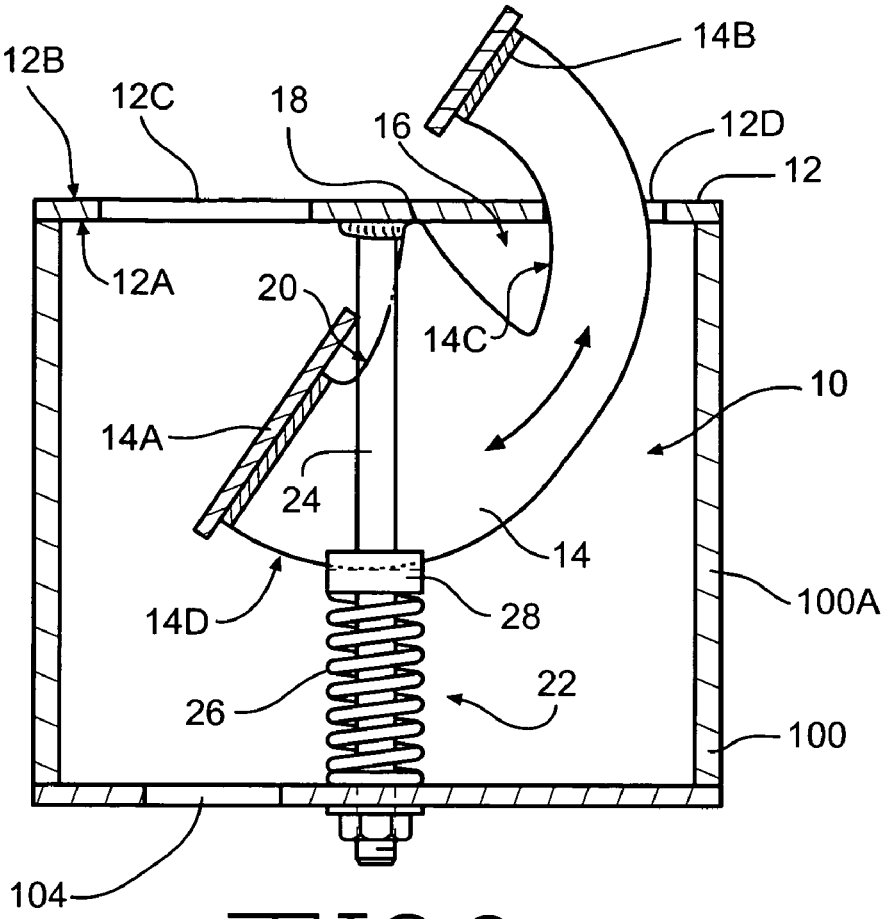
FIG. 3 is a cross-sectional view of the container 100 and the closure 10 in the open position with the spring mechanism 22 in elevation.
Figure 4:
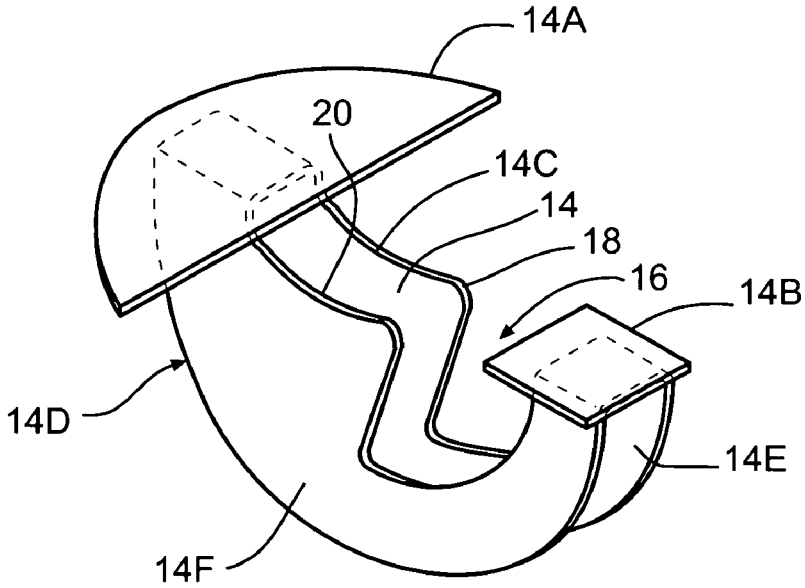
FIG. 4 is a perspective view of the pivotable member 14 of the embodiment of FIG. 3.
Figure 8:
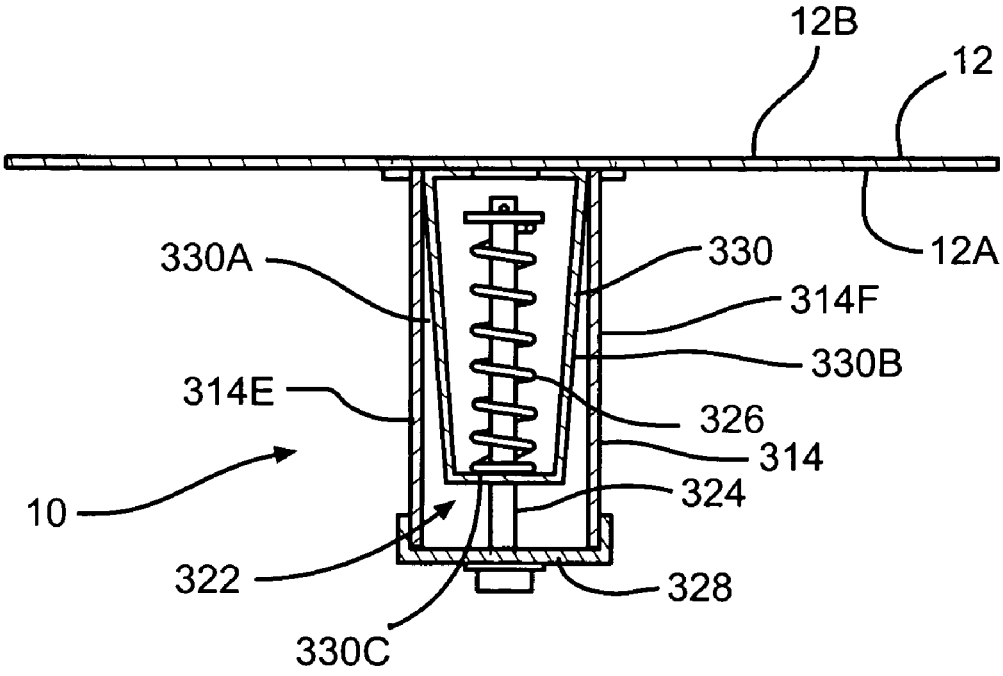
FIG. 8 is a cross-sectional view along the line 8-8 of FIG. 7 showing the pivotable member 314 and spring mechanism 322 of the closure 10.

The closure 10 of the present invention is used to open and close an opening in a container 100 and 200 to enable the container 100 and 200 to be filled with material or to allow the material in the container 100 and 200 to be dispensed from the container 100 and 200. The container 100 and 200 can be of any type well known in the art. In one (1) embodiment, the container 100 and 200 is intended to hold a solid, granular material such as salt, pepper or other spices. In another embodiment, the container 100 and 200 is intended to hold and dispense a liquid material. It is understood that the material can be any material well known in the art which is dispensable from a container 100 and 200 and which is movable or flowable such that the pivotable member 14, 214, 314 and 414 can move in the material in the interior of the container 100 and 200. In one (1) embodiment, the container 100 and 200 is constructed from a metal such as stainless steel, aluminum, brass or any other metal well known in the art. In another embodiment, the container 100 and 200 is constructed of plastic. In one (1) embodiment, the container 100 has a first opening 102 and a second opening 104. The first opening 102 is opened and closed by the closure 10 (FIGS. 2 and 3). In another embodiment, the container 200 has a single opening 202 which is opened and closed by the closure 10 (FIG. 8). The openings 102, 104 and 202 allow access to the interior of the container 100 and 200 for moving material into the container 100 and 200 or dispensing material from the container 100 and 200.

The closure 10 includes a lid 12, 212 and 412, a pivotable member 14, 214, 314 and 414 and a means for holding the pivotable member 14, 214, 314 and 414 in position adjacent to the lid 12, 212 and 412. The lid 12, 212 and 412 has a size and shape similar to the opening 102 and 202 of the container 100 and 200. In one (1) embodiment, the lid 12, 212 and 412 is constructed as a unitary piece with the sidewall 100A and 200A or sidewalls of the container 100 and 200. In another embodiment, the lid 12, 212 and 412 is a separate piece and is permanently mounted over the opening 102 and 202 in the container 100 and 200. In another embodiment, the lid 12, 212 and 412 is removably mounted over the opening 102 and 202 in the container 100 and 200.

The lid 12, 212 and 412 has a first side 12A and 212A and a second side 12B, 212B and 412B with spaced apart first and second openings 12C, 212C and 12D, 212D extending therethrough. The size and shape of the first opening 12C and 212C depends on the type and amount of material to be dispensed from or filled into the container 100 and 200. The size and shape of the second opening 12D and 212D depends on the size and shape of the pivotable member 14, 214, 314 and 414. The lid 12, 212 and 412 is positioned on the container 100 and 200 such that the first side 12A and 212A of the lid 12, 212 and 412 is facing the interior of the container 100 and 200 and the second side 12B, 212B and 412B of the lid 12, 212 and 412 is facing outward.

Figure 10:
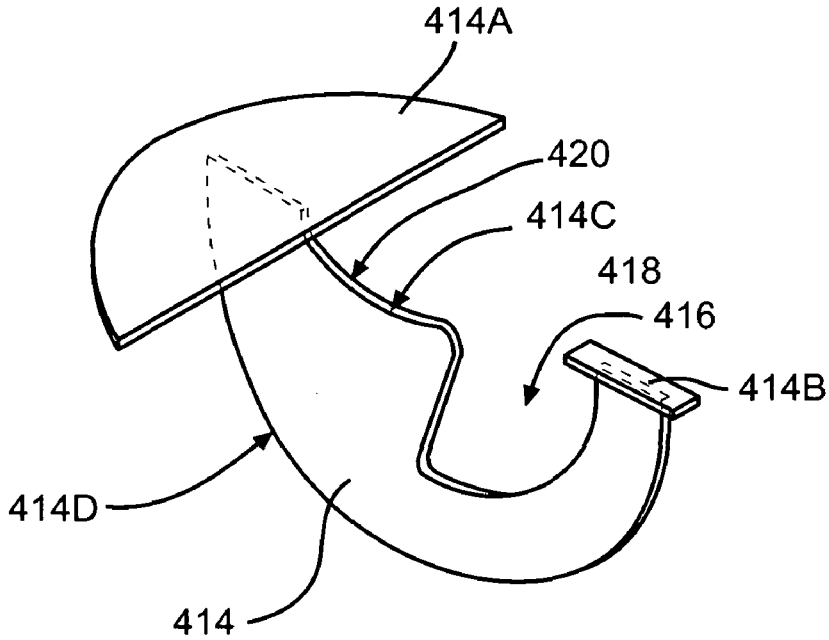
FIG. 10 is a perspective view of the pivotable member 414 of the embodiment of FIG. 9.

The pivotable member 14, 214, 314 and 414 is positioned adjacent the first side 12A and 212A of the lid 12, 212 and 412 in the interior of the container 100 and 200. The pivotable member 14, 214, 314 and 414 has a first end 14A, 214A, 314A and 414A and a second end 14B, 214B, 314B and 414B with a first surface 14C, 214C, 314C and 414C and a second surface 14D, 214D, 314D and 414D extending therebetween. In one (1) embodiment, the pivotable member 14, 214 and 314 is constructed of two spaced apart legs 14E, 214E, 314E and 14F, 214F, 314F. The legs 14E, 214E and 314E and 14F, 214F and 314F are connected together to the first and second ends 14A, 214A and 314A and 14B, 214B and 314B of the pivotable member 14, 214 and 314. In another embodiment, the pivotable member 414 is a solid, unitary piece (FIG. 10).

Figure 5:
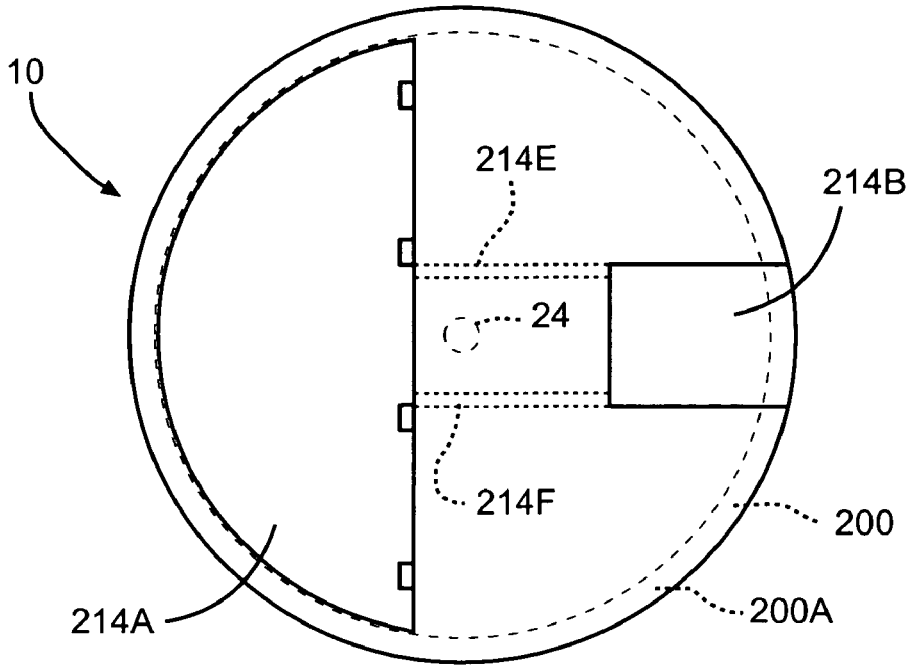
FIG. 5 is a top view of another embodiment of the container 200 and the closure 10 of the present invention.

The size and shape of the ends 14A, 214A, 314A and 414A and 14B, 214B, 314B and 414B of the pivotable member 14, 214, 314 and 414 vary depending on the size of the openings 12C, 212C and 12D, 212D in the lid 12, 212 and 412. In some embodiments, the first and second ends 214A, 414A and 214B, 414B of the pivotable member 214 and 414 have a size and shape similar to the size and shape of the first and second openings 212C and 212D, 312D in the lid 212 and 412 such that the ends 214A, 414A and 214B, 414B of the pivotable member 214 and 414 extend into and close the openings 212C and 212D when the closure 10 is in the closed position (FIG. 5). In one (1) embodiment, the second opening 212D in the lid 212 extends to the perimeter of the lid 212 so that when the second end 214B of the pivotable member 214 is in the fully closed position, the second end 214B rests on the sidewall 200A of the container 200 which prevents the second end 214B of the pivotable member 214 from extending into the interior of the container 200.

Figure 7:
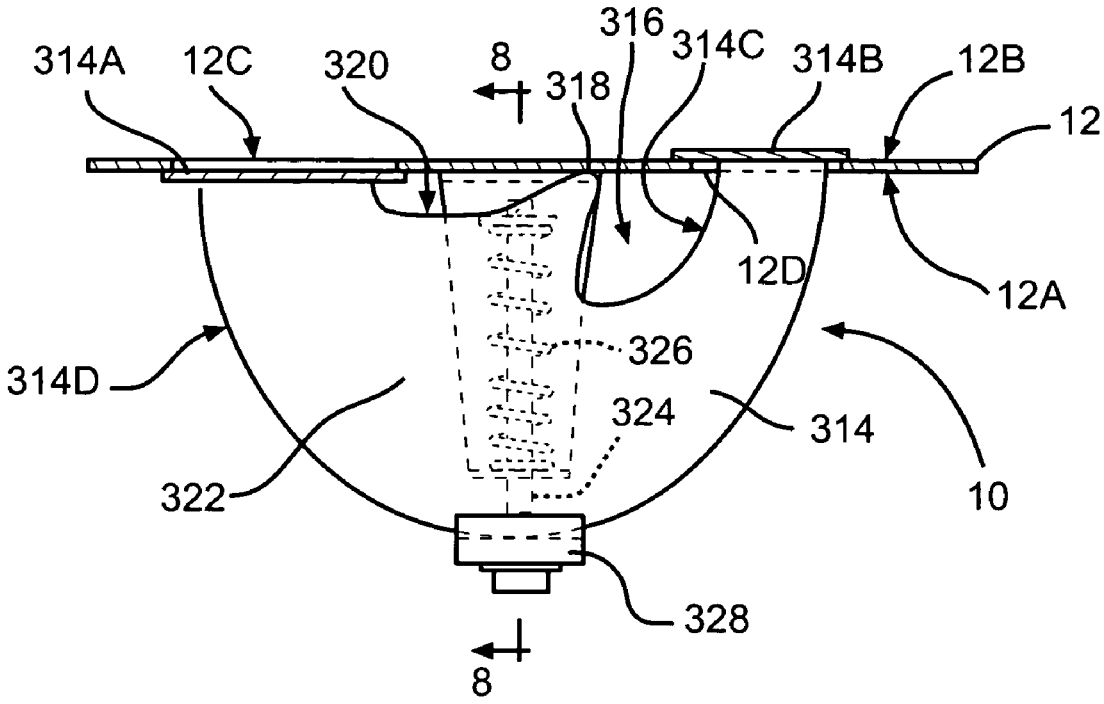
FIG. 7 is a partial cross-sectional view showing the lid 312 of the closure 10 and showing the pivotable member 314.

In some embodiments, the first end 14A and 314A of the pivotable member 14 and 314 has a size slightly larger than the first opening 12C in the lid 12 such that when the pivotable member 14 and 314 is in the closed position, the first end 14A and 314A contacts the first side 12A of the lid 12 around the perimeter of the first opening 12C and does not extend into the first opening 12C. In some embodiments, the second end 14B and 314B of the pivotable member 14 and 314 has a size greater than the size of the second opening 12D in the lid 12 so that when the pivotable member 14 and 314 is in the closed position, the second end 14B and 314B contacts the second side 12B of the lid 12 around a perimeter of the second opening 12D in the lid 12 (FIGS. 2 and 7). In some embodiments, the size and shape of the first and second ends 14A, 314A and 14B, 314B of the pivotable member 14 and 314 is such that the ends 14A, 314A and 14B, 314B seal the first and second openings 12C and 12D in the lid 12 when the pivotable member 14 and 314 is in the closed position. In one (1) embodiment where the material is a liquid, the first and second ends 14A, 214A, 314A and 414A and 14B, 214B, 314B and 414B of the pivotable member 14, 214, 314 and 414 have seals (not shown) such that in the closed position, the first and second ends 14A, 214A, 314A and 414A and 14B, 214B, 314B and 414B of the pivotable member 14, 214, 314 and 414 seal the first and second openings 12C, 212C and 12D, 212D in the lid 12, 212 and 412 and do not allow the liquid material to exit or enter the container 100 and 200. In one (1) embodiment, the outer edge of the first end 14A, 214A and 414A of the pivotable member 14, 214, and 414 has a shape or contour similar to the shape or contour of the sidewall 100A and 200A of the container 100 and 200 adjacent the first end 14A, 214A and 414A of the pivotable member 14, 214 and 414. In this embodiment, as the pivotable member 14, 214 and 414 moves away from and toward the open position, the first end 14A, 214A and 414A of the pivotable member 14, 214 and 414 moves in the interior of the container 100 and 200 and follows along a portion of the sidewall 100A and 200A of the container 100 and 200. In this embodiment, the first end 14A, 214A and 414A of the pivotable member 14, 214 and 414 contacts the sidewall 100A and 200A of the container 100 and 200 and the sidewall 100A and 200A of the container 100 and 200 acts as a guide to keep the pivotable member 14, 214 and 414 in the correct position during the opening or closing of the closure 10.

Figure 6:
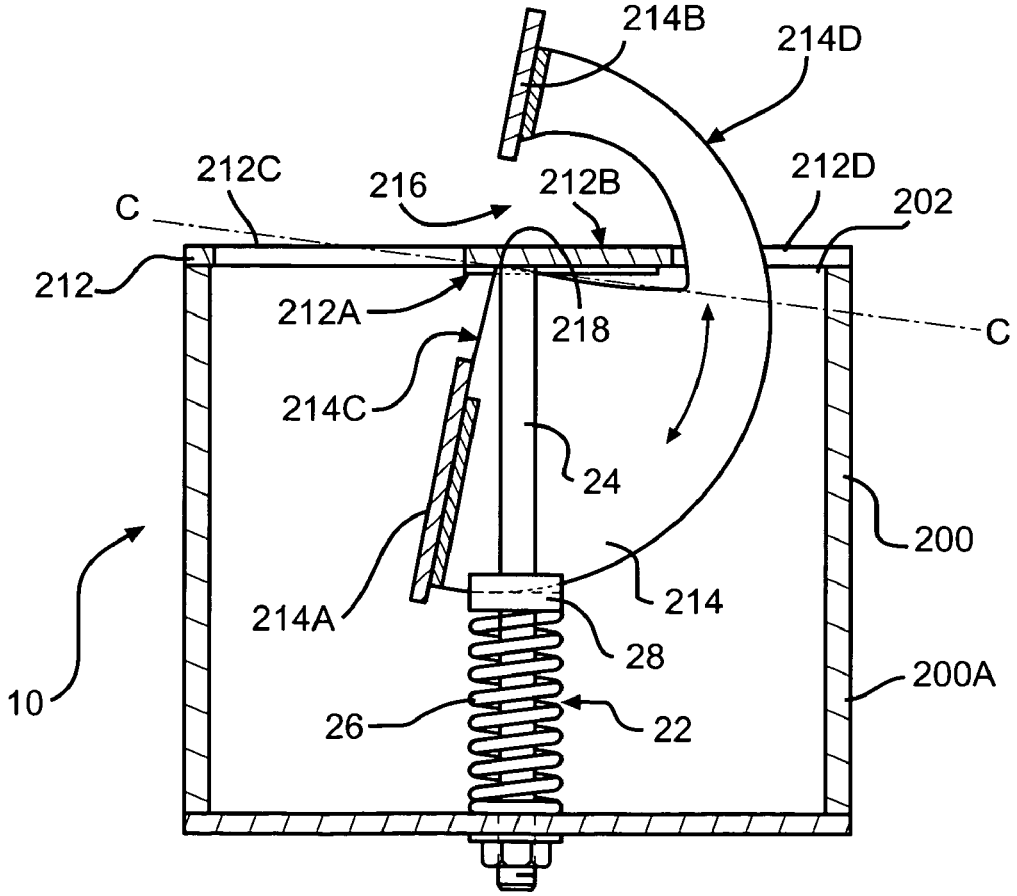
FIG. 6 is a cross-sectional view showing the closure 10 in the fully open position and showing the spring mechanism 22 in elevation.

The first surface 14C, 214C, 314C and 414C of the pivotable member 14, 214, 314 and 414 can have a variety of shapes. A first recess 16, 216, 316 and 416 is provided in the first surface 14C, 214C, 314C and 414C adjacent the second end 14B, 214B, 314B and 414B of the pivotable member 14, 214, 314 and 414. The first recess 16, 216, 316 and 416 extends inward toward the second surface 14D, 214D, 314D and 414D and extends the entire width of the pivotable member 14, 214, 314 and 414 between the sides of the pivotable member 14, 214, 314 and 414. The first recess 16, 216, 316 and 416 allows the pivotable member 14, 214, 314 and 414 to pivot so that the second end 14B, 214B, 314B and 414B of the pivotable member 14, 214, 314 and 414 can extend out of the second opening 12D and 212D in the lid 12, 212 and 412. In one (1) embodiment, the first recess 216 extends between the centerline C-C of the pivotable member 214 and the second end 214B of the pivotable member 214 (FIG. 6). In one (1) embodiment of this embodiment, the side of first recess 216 at the centerline C-C of the pivotable member 214, extends outward toward the second surface 214D in a direction essentially perpendicular to the lid 212 when the pivotable member 214 is in the fully closed position such that one (1) side of the first recess 216 is essentially flat. In one (1) embodiment, the side of the first recess 216 extends essentially perpendicular to the plane formed by the ends 214A and 214B of the pivotable member 214.

A pivot surface 18, 218, 318 and 418 is provided on the first surface 14C, 214C, 314C and 414C of the pivotable member 14, 214, 314 and 414 spaced between the ends 14A and 14B of the pivotable member 14, 214, 314 and 414. The pivot surface 18, 218, 318 and 418 contacts the first side 12A and 212A of the lid 12, 212 and 412 to enable the pivotable member 14, 214, 314 and 414 to pivot. In one (1) embodiment, the pivot surface 18, 318 and 418 is curved to provide a large, smooth area of contact with the lid 12 and 412. In one (1) embodiment, the pivot surface 218 is positioned at the centerline C-C of the pivotable member 214 (FIG. 6). The centerline C-C of the pivotable member 14, 214, 314 and 414 is defined as the part equally spaced from the second surface 14D, 214D, 314D and 414D at the first end 14A, 214A, 314A and 414A of the pivotable member 14, 214, 314 and 414 and the second surface 14D, 214D, 314D and 414D at the second end 14B, 214B, 314B and 414B of the pivotable member 14, 214, 314 and 414. In one (1) embodiment, the pivot surface 18, 318 and 418 is offset from the centerline C-C in a direction toward the second end 14B, 314B and 414B of the pivotable member 14, 314 and 414.

In one (1) embodiment, a second recess 20, 320 and 420 is provided in the first surface 14C, 314C and 414C between the pivot surface 18, 318 and 418 and the first end 14A, 314A and 414A of the pivotable member 14, 314 and 414. The second recess 20, 320 and 420 extends inward toward the second surface 14D, 314D and 414D and extends the entire width of the pivotable member 14, 314 and 414 between the sides of the pivotable member 14, 314 and 414. The second recess 20, 320 and 420 allows the pivotable member 14, 314 and 414 to pivot in both directions on the pivot surface 18, 318 and 418. In one (1) embodiment, the first surface 214C between the pivot surface 218 and the first end 214A is straight or flat (FIG. 6).

The second surface 14D, 214D, 314D and 414D of the pivotable member 14, 214, 314 and 414 has a curved shape. In one (1) embodiment, the curvature of the second surface 14D, 214D, 314D and 414D is such that the first and second ends 14A, 214A, 314A, 414A and 14B, 214B, 314B, 414B of the pivotable member 14, 214, 314 and 414 are in essentially the same plane. In one (1) embodiment, the second surface 14D, 214D, 314D and 414D has an essentially semi-circular shape with a radius slightly less than one-half the distance between the outer edges of the openings 12C, 212C and 12D, 212D of the lid 12, 212 and 312. In one (1) embodiment, the second surface of the pivotable member is shaped so that the distance between the pivot surface and the second surface increases from the first end toward the centerline and from the centerline toward the first end so that the greatest distance between the pivot surface and the second surface is at a point spaced between the centerline and the first end of the pivotable member. In one (1) embodiment where the pivot surface 18, 318 and 418 is offset toward the second end 14B, 314B and 414B of the pivotable member 14, 314 and 414, the distance between the pivot surface 18, 318 and 418 and the second surface 14D, 314D and 414D is greatest at the first end 14A, 314A and 414A of the pivotable member 14, 314 and 414.

The pivotable member 14, 214, 314 and 414 is held in position adjacent or in contact with the first side 12A and 212A of the lid 12, 212 and 412 by a force exerted on the second surface 14D, 214D, 314D and 414D of the pivotable member 14, 214, 314 and 414. The strength of the force allows the pivotable member 14, 214, 314 and 414 to rock or pivot between the open and closed positions on the first side 12A and 212A of the lid 12, 212 and 412. In one (1) embodiment, the pivotable member 14 and 214 is held adjacent to the first side 12A and 212A of the lid 12 and 212 by a spring mechanism 22. The spring mechanism 22 includes a post 24 which extends between the lid 12 and 212 and a bottom wall or an opposed section of the container 100 and 200 opposite the lid 12 and 212. In one (1) embodiment, the post 24 is secured to the lid 12 and 212 and to the bottom wall of the container 100 and 200. One (1) end of the post 24 is positioned between the first and second openings 12C, 212C and 12D, 212D in the lid 12 and 212. The post 24 can be mounted in the interior of the container 100 and 200 by any well known means. A spring 26 is positioned around the post 24 adjacent the bottom wall or opposed portion of the container 100 and 200. In one (1) embodiment, the spring 26 is a compression spring. A contact pad 28 is positioned on the post 24 adjacent the end of the spring 26 opposite the bottom wall or opposed section of the container 100 and 200. The second surface 14D and 214D of the pivotable member 14 and 214 contacts and rests on the side of the contact pad 28 opposite the spring 26. In the embodiment where the pivotable member 14 and 214 is formed by two (2) spaced apart legs 14E, 214E and 14F, 214F, the post 24 extends between the legs 14E, 214E and 14F, 214F and the contact pad 28 contacts the second surface 14D and 214D of each leg 14E, 214E and 14F, 214F. In one (1) embodiment, the contact pad 28 has sides which extend upward along the sides of the pivotable member 14 and 214 to assist in positioning the pivotable member 14 and 214 on the contact pad 28.

In another embodiment, the spring mechanism 322 includes a post 324, a spring 326, a contact pad 328 and a support bracket 330 (FIG. 8). The support bracket 330 is mounted on the first side 12A of the lid 12 between the first and second openings 12C and 12D in the lid 12. The support bracket 330 has support legs 330A and 330B and a bottom support 330C. The bottom support 330C extends between the legs 330A and 330B spaced apart from and essentially parallel to the lid 12. The post 324 extends from a point adjacent the first side 12A of the lid 12 between the support legs 330A and 330B of the support bracket 330 through a hole in the bottom support 330C to the contact pad 328. The post 324 is secured to the contact pad 328 and is able to slide in the hole in the bottom support 330C of the support bracket 330. The spring 326 is positioned around the post 324 and extends between the first end 324A of the post 324 adjacent the lid 12 and the bottom support 330C of the support bracket 330. The contact pad 328 contacts the second surface 314D of the pivotable member 314 on a side adjacent the spring 326. In the one (1) embodiment where the pivotable member 314 is formed by two (2) spaced apart legs 314E and 314F, the support bracket 330 and spring 326 are positioned between the legs 314E and 314F of the pivotable member 314 and the second end 324B of the post 324 is secured to the contact pad 328 at a point spaced between the legs 314E and 314F of the pivotable member 314. It is understood that other types of biasing means or resilient members well known in the art can be used as means to hold the pivotable member 14, 214, 314 and 414 in position adjacent or in contact with the lid 12, 212 and 412.

To use the closure 10, the lid 12, 212 and 412 is secured to the container 100 and 200 so that the lid 12, 212 and 412 covers the opening of the container 100 and 200 and the pivotable member 14, 214, 314 and 414 and means for holding the pivotable member 14, 214, 314 and 414 adjacent to or in contact with the lid 12, 212 and 412 are located in the interior of the container 100 and 200. In the closed position, the first and second ends 14A, 214A, 314A and 414A and 14B, 214B, 314B and 414B of the pivotable member 14, 214, 314 and 414 close the first and second openings 12C, 212C and 12D, 212D respectively in the lid 12, 212 and 412. In the closed position, the pivot surface 18, 218, 318 and 418 is in contact with the first side 12A and 212A of the lid 12, 212 and 412. In the closed position, the means for positioning the pivotable member 14, 214, 314 and 414 exerts an upward force on the second surface 14D, 214D, 314D and 414D of the pivotable member 14, 214, 314 and 414, to hold the pivot surface 18, 218, 318 and 418 in contact with the first side 12A and 212A of the lid 12, 212 and 412. In one (1) embodiment, the means for positioning the pivotable member 14, 214, 314 and 414 exerts a force which resists the movement of the pivotable member 14, 214, 314 and 414 from the closed position to the open position. In one (1) embodiment where the material in the container 100 is a liquid, the positioning means provides a holding force which creates a seal between the first and second ends 14A, 14B and 314A, 314B of the pivotable member 14 and 314 and the first and second openings 12C and 12D in the lid 12. In one (1) embodiment having a spring mechanism 22 and 322, the spring constant of the spring 26 and 326 is chosen so that when the spring 26 and 326 is at essentially a free length or slightly less than free length so that the spring mechanism 22 and 322 exerts only a minimal force to keep the pivot surface 18, 218, 318 and 418 in contact with the lid 12, 212 and 412, the contact pad 28 and 328 is spaced apart from the first side 12A and 212A of the lid 12, 212 and 412 a distance essentially equal to the distance between the pivot surface 18, 218, 318 and 418 and the second surface 14D, 214D, 314D and 414D of the pivotable member 14, 214, 314 and 414 at the centerline of the pivotable member 14, 214, 314 and 414.

To move the closure 10 from the closed position into the open position, a force is applied to the first end 14A, 214A, 314A and 414A of the pivotable member 14, 214, 314 and 414 to move the first end 14A, 214A, 314A and 414A into the interior of the container 100 and 200. The force applied to the first end 14A, 214A, 314A and 414A can be directly downward into the interior of the container 100 or 200. As the first end 14A, 214A, 314 and 414A moves into the interior of the container 100 and 200, the pivotable member 14, 214, 314 and 414 pivots on the pivot surface 18, 218, 318 and 418 so that the second end 14B, 214B, 314B and 414B of the pivotable member 14, 214, 314 and 414 extends out of the container 100 and 200 beyond the second side 12B, 212B and 412B of the lid 12, 212 and 412. As the pivotable member 14, 214, 314 and 414 moves toward the open position, the second surface 14D, 214D, 314D and 414D of the pivotable member 14, 214, 314 and 414 moves along the contact pad 28 and 328 of the spring mechanism 22 and 322. The curved shape of the second surface 14D, 214D, 314D and 414D allows the pivotable member 14, 214, 314 and 414 to move smoothly on the contact pad 28 and 328. As the pivotable member 14, 214, 314 and 414 continues to move towards the open position, the shape of the second surface 14D, 214D, 314D and 414D moves the first end 14A, 214A, 314A and 414A of the pivotable member 14, 214, 314 and 414 towards the center point between the first and second openings 12C, 212C and 12D, 212D in the lid 12, 212 and 412 and out of the path of the first opening 12C and 212C. In the fully open position, the first end 14A, 214A, 314A and 414A of the pivotable member 14, 214, 314 and 414 does not interfere with or obstruct the insertion or dispensing of material through the first opening 12C and 212C. The shape of the second surface 14D, 214D, 314D and 414D of the pivotable member 14, 214, 314 and 414 is such that as the pivotable member 14, 214, 314 and 414 moves toward the open position, the second end 14B, 214B, 314B and 414B moves out of the second opening 12D and 212D and curves toward the first opening 12C and 212C. As the pivotable member 14, 214, 314 and 414 moves from the closed position to the open position, the pivot surface 18, 218, 318 and 418 slides along the first side 12A and 212A of the lid 12, 212 and 412. In one (1) embodiment, as the pivotable member 14, 314 and 414 moves from the fully closed position to the fully open position, the pivot surface 18, 318 and 418 first slides towards the second opening 12D away from the first opening 12C and then slides back toward the first opening 12C. In one (1) embodiment, the pivot surface 18, 318 and 418 moves along the lid 12 and 412 such that the portion of the pivot surface 18, 318 and 418 in contact with the lid 12 and 412 changes.

Figure 9:
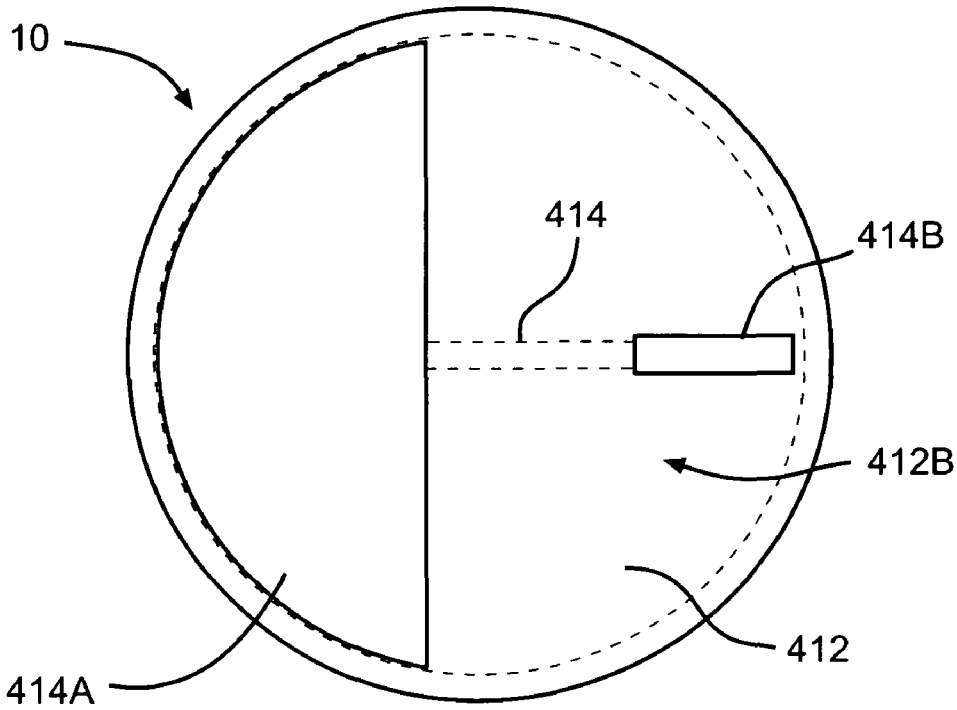
FIG. 9 is a top view of another embodiment of the container with the closure 10.

In the embodiment where the second surface 214D of the pivotable member 214 has a semi-circular shape and the pivot surface 218 is at the centerline C-C of the pivotable member 214, the second surface 214D of the pivotable member 214 is always the same distance from the pivot surface 218. In this embodiment, when the pivotable member 214 moves, there is no movement or compression of the spring 26 of the spring mechanism 22. In this embodiment, there is essentially no force or nominal force tending to hold the pivotable member 214 in the closed or open position (FIG. 9). In this embodiment where the first side of the first recess 216 is essentially flat and is located at the centerline C-C of the pivotable member 214, when the pivotable member 214 is moved to the fully open position, the force of the spring mechanism 22 moves the first side of the first recess 216 into contact with the first side 212A of the lid 212 which creates a locking force which tends to hold the pivotable member 214 in the open position.

In another embodiment where the second surface 314D of the pivotable member 314 has an essentially semi-circular shape with a radius slightly less than one-half the distance between the outer edges of the openings 12C and 12D in the lid 12 and the pivot surface 318 is offset from the centerline C-C in a direction toward the second end 314B of the pivotable member 314, the distance between the pivot surface 318 and the second surface 314D increases as the pivotable member 314 moves from the closed position to the open position. As the pivotable member 314 moves, the increase in distance compresses the spring 326 of the spring mechanism 322. As the pivotable member 14, 314 and 414 moves from the closed position to the open position, the shape of the pivotable member 14, 314 and 414 and the distance between the pivot surface 18, 318 and 418 and the second surface 14D, 314D and 414D of the pivotable member 14, 314 and 414 provides a camming action which moves the contact pad 28 and 328 away from the lid 12 and 412 toward the bottom wall or opposed section of the container 100. As the contact pad 28 and 328 moves, the spring 26 and 326 of the spring mechanism 22 and 322 is compressed and exerts a greater upward force on the second surface 14D, 314D and 414D of the pivotable member 14, 314 and 414. In the embodiment where the spring 26 extends between the contact pad 28 and the bottom wall or opposed section of the container 100, the contact pad 28 moves downward toward the bottom wall or opposed section of the container 100 and compresses the spring 26. In the embodiment where the spring 326 is between the bottom support 330C of the support bracket 330 and the first side 12A of the lid 12, as the contact pad 328 moves downward, the post 324 also moves downward. The first end 324A of the post 324 adjacent the lid 12 contacts the end of the spring 326 and compresses the spring 326 between the bottom support 330C and the first end 324A of the post 324. Once the pivotable member 14, 314 and 414 is in the fully open position, the force pushing upward on the second surface 14D, 314D and 414D of the pivotable member 14, 314 and 414 at the second end 14B, 314B and 414B combined with the shifting of the pivot surface 18, 318 and 418 toward the first opening 12C, acts to lock the pivotable member 14, 314 and 414 in the fully open position. The greater the distance between the pivot surface 18, 318 and 418 and the centerline C-C of the pivotable member 14, 314 and 414, the greater the force tending to lock the pivotable member 14, 314 and 414 in the open or closed positions.

To close the closure 10, a force is applied to the second end 14B, 214B, 314B and 414B of the pivotable member 14, 214, 314 and 414. In one (1) embodiment, the force is essentially parallel to the lid 12, 212 and 412 of the closure 10. In one (1) embodiment, the force is applied to the second end 14B, 214B, 314B and 414B at an angle of less than 90° to the lid 12, 212 and 412. The amount of initial force applied to the second end 14B, 214B, 314B and 414B of the pivotable member 14, 214, 314 and 414 must be sufficient to overcome the amount of force tending to hold the pivotable member 14, 214, 314 and 414 in the fully open position. In the embodiment where the contour of the second surface 14D, 214D, 314D and 414D of the pivotable member 14, 214, 314 and 414 is essentially smooth, the force holding the pivotable member 14, 214, 314 and 414 in either the open or closed position is easily overcome by a minimal counterforce. In one (1) embodiment, the force applied to close the closure 10 is removed after the initial application and the force pushing upward on the second surface 14D, 314D and 414D of the pivotable member 14, 314 and 414 automatically moves the pivotable member 14, 314 and 414 to the closed position. In the closed position, the means for holding the pivotable member 14, 214, 314 and 414 in position exerts a force on the pivotable member 14, 214, 314 and 414 which holds the pivotable member 14, 214, 314 and 414 in the closed position so that the first and second ends 14A, 214A and 14B, 214B of the pivotable member 14, 214, 314 and 414 are in or adjacent to the first and second openings 12C, 212C and 12D, 212D in the lid 12, 212 and 412 such as to close the openings 12C, 212C and 12D, 212D. In the embodiment where the pivot surface 218 is essentially at the centerline of the pivotable member 214, and the second surface 214D has an essentially semi-circular shape, and the first surface 214C between the centerline and the first end is flat, when the pivotable member 214 is in the closed position, the force pushing upward against the second surface 214D such as by the spring mechanism 22 moves the flat first surface 214C between the pivot surface 218 and the first end 214A into contact with the first side 212A of the lid 212. The contact of a larger, flat portion of the first surface 214C provides a locking effect which tends to lock the pivotable member 214 in the closed position. In one (1) embodiment, the amount of force keeping the pivotable member 14 and 314 in the closed position acts to move the first and second ends 14A, 314A and 14B, 314B of the pivotable member 14 and 314 into sealing contact with the openings 12C and 12D of the lid 12.

In the embodiments where the pivot surface 18, 318 and 418 is offset from the centerline C-C of the pivotable member 14, 314 and 414 toward the second end 14B, 314B and 414B and the second surface 14D, 314D and 414D has an essentially semi-circular shape, the distance between the pivot surface 18, 318 and 418 and the second surface 14D, 314D and 414D decreases at an increasing rate as the pivotable member 14, 314 and 414 moves from the open to the closed position. Compression of the spring 326 produces a force which acts to return the pivotable member 314 to the closed position. The decreasing distance accelerates the pivotable member 14, 314 and 414 toward the closed position. The greater the distance between the pivot surface 18, 318 and 418 and the centerline C-C of the pivotable member 14, 314 and 414, the greater the acceleration of the pivotable member 14, 314 and 414 toward the closed position.

In the embodiment where the pivot surface 18 and 318 is offset from the centerline of the pivotable member 14 and 314 toward the second end 14B and 314B and a second recess 20 and 320 is provided in the first surface 14C and 314C, the force on the second surface 14D and 314D of the pivotable member 14 and 314 by the spring mechanism 22 and 322 is applied at the centerline of the pivotable member 14 and 314 which is spaced apart from the pivot surface 18 and 318 below the second recess 20 and 320. In this embodiment, the force applied by the spring mechanism 22 and 322 is applied to the pivot surface 18 and 318 at an angle which moves the first end 14A and 314A of the pivotable member 14 and 314 into sealing contact with the first opening 12C in the lid 12 and moves the second end 14B and 314B into sealing contact with the second opening 12D in the lid 12.

It is intended that the foregoing description be only illustrative of the present invention and that the present invention be limited only by the hereinafter appended claims.

I claim:

1. A closure for a container having an opening, the closure which comprises:

(a) a lid having a first opening and a second opening and configured to cover the opening of the container;

(b) a pivotable member having a first end and a second end with a first surface and a second surface extending therebetween and positioned adjacent the lid;

(c) a pivot surface provided on the pivotable member between the ends of the pivotable member;

(d) a means for holding the pivotable member adjacent to the lid so that when the pivotable member moves between open and closed positions, the pivot surface contacts the lid and the pivotable member pivots on the pivot surface; and wherein a first recess is provided in the first surface spaced between the pivot surface and the second end of the pivotable member.

2. The closure of claim 1 wherein the lid has a first side and a second side and is configured to be positioned on the container such that the first side is adjacent an interior of the container and wherein the pivotable member is positioned adjacent the lid such that the pivot surface contacts the first side of the lid and the pivotable member is positioned in the interior of the container.

3. The closure of claim 2 wherein when the closure is in the closed position, the first end of the pivotable member is in contact with the first side of the lid and closes the first opening in the lid and the second end of the pivotable member is in contact with the second side of the lid and closes the second opening in the lid.

4. The closure of claim 2 wherein when the closure is in the open position, the first end of the pivotable member is positioned in the interior of the container and is spaced apart from the first opening in the lid and the second end of the pivotable member extends above the second opening in the lid in a direction away from the interior of the container so that the second end of the pivotable member is spaced apart from the second opening in the lid.

5. The closure of claim 1 wherein the means for holding the pivotable member adjacent the lid is a resilient member which biases the pivotable member toward the lid.

6. The closure of claim 1 wherein the second surface of the pivotable member is curved.

7. The closure of claim 6 wherein the second surface has a semi-circular shape.

8. The closure of claim 1 wherein the pivot surface is curved and wherein as the pivotable member pivots between the open and closed positions, the pivot surface moves on the lid.

9. The closure of claim 1 wherein the interior of the container is formed by a sidewall of the container, wherein an outer edge of the first end of the pivotable member has a shape essentially similar to the sidewall such that as the pivotable member moves between the open and closed positions, the outer edge of the first end follows along the sidewall such that the sidewall acts to position the pivotable member.

10. The closure of claim 1 wherein the pivot surface is at a centerline of the pivotable member spaced an equal distance from the second surface at each end of the pivotable member.

11. The closure of claim 1 wherein the means for holding the pivotable member adjacent to the lid is a spring mechanism which exerts a force on the second surface of the pivotable member.

12. The closure of claim 11 wherein the spring mechanism exerts a force at a centerline of the pivotable member spaced an equal distance from the second surface at each end of the pivotable member.

13. The closure of claim 1 wherein a side of the first recess adjacent the pivot surface is flat and extends toward the second surface.

14. The closure of claim 1 wherein a portion of the first surface spaced between the first end and the pivot surface is flat and parallel to a plane formed by the ends of the pivotable member.

15. The closure of claim 1 wherein the pivot surface is offset from a centerline of the pivotable member toward the second end of the pivotable member.

16. The closure of claim 1 wherein when the closure is in the closed position, the pivot surface is offset from the centerline of the container toward the second opening and when the closure is in the open position, the pivot surface is offset from the centerline of the container toward the first opening.

17. The closure of claim 13 wherein when the flat side of the recess lies flat against the lid, a portion of the lid between the pivot surface and the second opening extends into the first recess.

18. The closure of claim 11 wherein, when the spring mechanism exerts the force on the second surface of the pivotable member moves between open and closed positions, without compressing or expanding the spring mechanism.

19. A container having a first opening and a second opening to an interior of the container and having a closure for preventing access to the interior of the container, the closure which comprises:

a pivotable member having a first end and a second end with a spaced apart first surface and a second surface extending therebetween;

a pivot surface provided along the first surface of the pivotable member;

a biasing element holding the pivotable member adjacent the container so that when the pivotable member moves between open and closed positions, the pivot surface contacts the container and the pivotable member pivots on the pivot surface; and wherein a first recess is provided in the first surface spaced between the pivot surface and the second end of the pivotable member.

20. The container of claim 19 wherein a lid of the container has a first side and a second side and is configured to be positioned on the opening of the container such that the first side is adjacent the interior of the container and wherein the pivotable member is positioned adjacent to the lid such that the pivot surface contacts the first side of the lid and the pivotable member is positioned in the interior of the container; and wherein the closure has a shape such that when the closure is in the closed position, the first end of the pivotable member is adjacent the first side of the lid and closes the first opening in the lid and the second end of the pivotable member is adjacent the second side of the lid and closes the second opening in the lid and wherein when the closure is in the open position, the first end of the pivotable member is positioned in the interior of the container spaced apart from the first opening in the lid and the second end of the pivotable member extends beyond the second opening in the lid in a direction away from the interior of the container so that the second end is spaced apart from the second opening in the lid.

21. The container of claim 19 wherein the second surface of the pivotable member is curved and wherein the means for holding the pivotable member adjacent the lid contacts the second surface of the pivotable member.

22. The closure of claim 19 wherein the pivot surface is offset from a centerline of the pivotable member between the ends such that a distance between the pivot surface and the second surface at the first end is greater than a distance between the pivot surface and the second surface at the second end.

23. The closure of claim 22 wherein the biasing element holding the pivotable member adjacent the lid exerts a force on the pivotable member at the centerline of the pivotable member equally spaced between the ends of the pivotable member.

24. The container of claim 23 wherein the biasing element holding the pivotable member adjacent the lid is a spring mechanism and wherein when the pivotable member is moved from the open position to the closed position, the spring mechanism exerts a force on the pivotable member to move the pivotable member to the closed position.

25. The closure of claim 19 wherein a second recess is provided in the first surface spaced between the pivot surface and the first end of the pivotable member.

26. A closure operable between open and closed positions relative to a first opening and second opening in a lid of a container to respectively open and close both of the first and second openings at the same time, the closure comprising:

a pivotable member having first and second legs extending between a first end and a second end with a spaced apart first surface and a second surface extending therebetween, a size and shape of each of the first and second ends respectively matching a size and shape of the first and second openings so as to essentially seal the first and second opening when the closure is in the closed position;

a post extending downwardly from the lid toward a bottom of the container, at least a portion of the pole extending downwardly between the first and second legs and the first and second ends such that at least a portion of the post is surrounded on all sides by at least one of the first and second legs and ends;

a pivot surface provided along the first surface of the pivotable member;

a biasing element holding the pivotable member adjacent the lid so that, when the pivotable member moves between open and closed positions, the pivot surface pivots against the lid and the pivotable member pivots on the pivot surface.

27. The closure of claim 26 wherein when the biasing element applies a force to the second surface while the closure moves between the open and closed positions, the force remains constant while the closure moves between the open and closed positions.

28. The closure of claim 26 wherein the pivot surface is offset from the post toward the second opening when the closure is completely closed and the pivot surface is offset from the post toward the first opening when the closure is completely open.

29. The closure of claim 26 wherein a first recess is provided in the first surface spaced between the pivot surface and the second end of the pivotable member and the pivot surface is disposed closer to an outer end of the second end than an outer end of the first end.

* * * * *